United States Patent [19]

Denkler et al.

[11] 4,391,745

[45] Jul. 5, 1983

[54] DESIZING AGENT AND PROCESS FOR PREPARATION THEREOF

[75] Inventors: Maria Denkler, Munich, Fed. Rep. of Germany; Frédéric Braun, Vienne, France

[73] Assignee: Diamalt Aktiengesellschaft, Munich, Fed. Rep. of Germany

[21] Appl. No.: 283,816

[22] Filed: Jul. 16, 1981

Related U.S. Application Data

[63] Continuation of Ser. No. 127,968, Mar. 7, 1980, abandoned.

[30] Foreign Application Priority Data

Mar. 9, 1979 [DE] Fed. Rep. of Germany ..... 2909396

[51] Int. Cl.[3] ..... C11D 3/386; C11D 11/00; D06L 1/14; D06L 16/00

[52] U.S. Cl. ..... 252/554; 8/138; 252/173; 252/174.21; 252/174.12; 252/DIG. 12; 252/DIG. 14

[58] Field of Search ..... 8/138; 252/132, 173, 252/174.12, 174.21, DIG. 12, 554

[56] References Cited

U.S. PATENT DOCUMENTS

| | | | |
|---|---|---|---|
| 2,974,001 | 3/1961 | Windbichler | 8/138 |
| 3,472,783 | 10/1969 | Smillie | 252/174.12 |
| 3,557,002 | 1/1971 | McCarty | 252/174.12 |
| 3,627,688 | 12/1971 | McCarty | 252/153 |
| 3,634,266 | 1/1972 | Theile | 252/132 |
| 3,676,374 | 7/1972 | Zaki | 252/551 |
| 3,697,451 | 10/1972 | Mausner | 252/545 |
| 3,717,550 | 2/1973 | Ziffer | 195/63 |
| 3,741,902 | 6/1973 | Barrett | 252/90 |
| 3,860,536 | 1/1975 | Landwerlen | 252/551 |
| 4,016,040 | 4/1977 | Win | 195/68 |
| 4,195,974 | 4/1980 | Kothe | 8/138 |

OTHER PUBLICATIONS

Madsen, G. B., et al.: "A New, Heat Stable Bacterial Amylase and its Use in High Temperature Liquefaction", *Die Starke*, 25, pp. 304–308 (1973).

*Enzylase HT-Entschlichtungsmittel fur die Textilindustrie*, Produkt-Information, published by Diamalt, Munich, Germany, 1977, 4 pages.

McCutcheon's Detergents & Emulsifiers-1978 North American Edition, M. C. Publishing Co., Glen Rock, N.J., p. 163.

*Primary Examiner*—Dennis L. Albrecht

[57] ABSTRACT

This invention deals with the removal of starch and starch-containing substances from various fabrics and the like. This is accomplished by simultaneously using an admixture of starch decomposing enzymes and an appropriate surfactant.

8 Claims, No Drawings

DESIZING AGENT AND PROCESS FOR PREPARATION THEREOF

This application is a continuation of application Ser. No. 127,968, filed Mar. 7, 1980, now abandoned.

INTRODUCTION

This invention relates to the removal of starch and starch containing sizing materials. More particularly this is accomplished by a mixture of enzymes and surfactants.

BACKGROUND OF THE INVENTION

It is known to remove starch and starch-containing sizing materials from textile substrates by impregnating sized fabric with enzyme solutions which decompose starch, the treatment being carried out under conditions suitable for cleavage of the starch sizing to water-soluble cleavage products and subsequent removal of the decomposition products of the starch sizing by a washing process. As starch-decomposing enzymes, one can use amylases from malt and pancreas or from mold or bacteria cultures.

It is known further to cultivate, by appropriate adaptation and selection of amylase-producing bacteria, strains which are characterized by high temperature-insensibility and stability. Amylases from cultures of these strains can also be used at temperatures of 100° C. and higher as desizing agents. They are known as high-temperature amylases (G. B. Madsen, B. E. Norman, S. Slott: "Die Stärke", 25, 304 (1973)).

For conducting the desizing, especially for the better wetting of the textile material with the desizing solution, it is also known to add wetting agents to the desizing bath (German Pat. No. 849,987; German Auslegeschriften Nos. 1,135,857 and 1,041,468; "Process Biochemistry 5" (1970) 8,17–19; "Melliand Textilberichte", 1970,1060–1062). Such wetting agents promote the absorption capacity of the fabric but display, more often than not, enzyme-inhibiting or enzyme-injuring action. The wetting agents are, therefore, always first brought into contact with the enzyme in the desizing bath when it is not possible, through certain combinations, to prepare free flowing pulverulent compositions (German Pat. No. 849,987; German Auslegeschrift No. 1,041,468). Most surfactants, especially the anionic surfactants, as, for example, sulfonic acids, are, however, inhibitors of enzyme action and strong enzyme poisons which cannot be used even for a short time in the desizing bath. In general, non-ionic surfactants inhibit the desizing enzymes less than anionic surfactants.

SUMMARY OF THE INVENTION

It has now been found, surprisingly, that a significant improvement in desizing can be obtained when the starch-decomposing enzyme and certain non-ionic surfactants are added to the desizing bath, not separately, but in the form of a previously prepared desizing agent which contains the starch-decomposing enzyme and the surfactants in intimate mixture in an aqueous medium, preferably in the form of a mutual emulsion.

An object of the invention is thus a desizing agent comprising an intimate mixture of a starch-decomposing enzyme, preferably a high-temperature bacteria amylase, and a non-ionic tensid selected from the group consisting of alkyl- and alkaryl oxalkylates, in water.

In is especially surprising that the desizing action can be further improved by the addition to the non-ionic surfactant of a smaller amount of an anionic surfactant, preferably a paraffin sulfonate. Since the anionic surfactant itself is known as an enzyme poison, this action is especially surprising. As the starch-decomposing enzyme, amylases of animal, plant or bacterial origin can be used. Preferred are the high-temperature amylases disclosed hereinbefore. The amylases are added in the form of aqueous solutions or dispersions.

Non-ionic surfactant suitable for the invention are alkylphenol oxalkylates such as nonylphenol oxyethylate, fatty alcohol oxalkylates, such as lauryl alcohol oxyethylate, and fatty acid oxalkylates. Alkylphenol oxyethylates are preferred.

Suitable anionic surfactants are, for example, paraffin sulfonates, alkylbenzene sulfonates, e.g. dodecylbenzene sulfonate as well as alkali metal salts of higher carboxylic acids. Paraffin sulfonates are preferred.

Especially preferred is a combination of paraffin sulfonate and alkylphenol oxyethylate. Especially preferred is the surfactant Kieralon OL (BASF) which has the following composition: 8% paraffin sulfonate sodium salt ($C_{14}/C_{15}$), 59% alkylphenol oxyethylate (6–7 EO), 32% water, 1% $Na_2SO_4$ (67% dry material).

The desizing agent in accordance with the invention comprises, in general, 10–40 parts of aqueous enzyme preparation and 10–60 parts of surfactant components. Among the surfactant components is a preferred mixture of 0.5–20 parts of anionic surfactant with 10–40 parts of a non-ionic surfactant. A preferred composition of desizing agent in accordance with the invention comprises 0.5–20 and preferably 1–10% of an anionic surfactant, preferably paraffin sulfonate; 10–40%, preferably 15–25% of an non-ionic surfactant, preferably alkylphenol oxyethylate, and 10–40%, preferably 25–40%, of the aqueous enzyme preparation, the rest being water and, optionally, small amounts of salt which originate in the neutralization.

Especially preferred is a composition comprising 10–40 parts of an aqueous enzyme preparation and 10–60 parts of a surfactant mixture of 5–15 parts, preferably 7–9 parts, paraffin sulfonate sodium salt and 50–70 parts, preferably 55–65 parts of, alkylphenol oxyethylate.

The mixture according to the invention exhibits a synergistic desizing action which far exceeds the additive action of the individual components when added separately to the desizing bath.

For the preparation of a mixture of the disclosed components in accordance with the invention a paste is first prepared from the surfactant and, optionally, water if desired, an amount of sodium or potassium hydroxide necessary for the neutralization of the surfactants can be added. To this paste is also admixed the culture solution of the high-temperature bacteria amylase into a very fine emulsion.

The desizing agent in accordance with the invention is especially suitable for the desizing of cotton, rayon or PE mixed fabrics which are sized with native or modified starch, if desired in admixture with CMC, PVA and/or polyacrylates as well as sizing fats and waxes. It displays a significantly stronger action than an analogous sizing bath prepared from the same amounts of the stated components added individually.

The effectiveness of the sizing bath depends upon the activity and concentration of added enzyme and can be quantified by enzyme activity indices. Hereinafter the analysis utilizes the technical specifications of Chapter 29.40 of the Brussels Customs Tariff. The results are, therefore, expressed in the so-called "customs units". The desizing activity on the fabric can be characterized directly by the so-called "iodine test", which utilizes the known iodine-starch color reaction for semi-quantitative expression. In this connection a "violet scale" (W. Jülicher, *Melliand* 36, 1923 (1955)) was formulated, which has found wide acceptance in the textile industry. The testing of the degrees of desizing is accomplished by the use of an iodine-potassium iodide solution and visual color comparison with the grades 1–9 of said violet scale. As a practical matter, desizing is said to be good when a grade equal to or greater than 6 is attained.

EXAMPLES

The following examples merely serve to illustrate the invention in specific detail and when read in conjunction with the foregoing description will aid in determining the full scope of the present invention. The examples are merely illustrative and are not intended to restrict this invention. All parts, percentages and ratios set forth herein are by weight unless otherwise indicated.

EXAMPLE 1

In a mixer provided with a rapid stirrer, 3.0 kg of paraffin sulfonate sodium salt and 18.1 kg of nonylphenol oxyethylate (oxyethylation degree 7) were stirred with 50 l of water to obtain a homogeneous paste. Under vigorous stirring, 35 kg of a high-temperature amylase solution was added and emulsified into the paste. The amylase solution utilized had an activity of 900,000 units, determined by the method of the technical specifications in Chapter 29.40 of the Customs Tariff. A yellowish-brown paste was obtained.

With the mixture so obtained, a polyester-rayon twill 34/19-2/2 having 400 g/m$^2$ and a sizing of 16.5% comprising 7.8% modified starch
3.9% polyvinylalcohol
3.9% carboxymethylcellulose
0.9% polywax was desized.

There followed treatment in a series washing machine in which the individual compartments were charged as follows:

1st compartment: 3 g/l of the mixture according to the invention, 90°–95° C. and pH ca. 7;
2nd compartment: 2 g/l of the mixture according to the invention, 90°–95° C. and pH ca. 7;
3rd compartment: 1 g/l of the mixture according to the invention, 90°–95° C. and pH ca. 7;
4th compartment: 3 g/l soda, boiling;
5th compartment: hot water, ca. 90° C.;
6th compartment: cold water, ca. 30° C.;

The travel velocity of the material was 30 m/min. which provided a contact time in the enzyme bath of 60 sec. total. The desizing grade, judged according to the violet scale, was 8–9.

As a comparison with the aforedescribed desizing, the same fabric was treated under the same conditions, with the identical amylase solution used for the preparation of the mixture according to the invention. As the wetting agent, the above-mentioned tensid mixture was used.

1st compartment:
1.00 g/l culture solution
1.00 g/l wetting agent, 90°–95° C., pH ca. 7;
2nd compartment:
0.66 g/l culture solution
0.75 g/l wetting agent, 90°–95° C., pH ca. 7;
3rd compartment:
0.33 g/l culture solution
0.50 g/l wetting agent, 90°–95° C., pH ca. 7;
4th compartment: 3 g/l soda, boiling;
5th compartment: hot water, ca. 90° C.;
6th compartment: cold water, ca. 30° C.

The desizing grade was less than 6. Surprisingly, in spite of higher concentrations of chemicals and equal amounts of the enzyme, a poorer desizing action was found.

EXAMPLE 2

With the mixture according to the invention and described in Example 1, a cotton nettle cloth having 180 g/m$^2$ and a sizing of 9% (starch, polyvinyl alcohol and sizing fat) was treated.

The desizing was carried out in a jigger (2 passes, 20 min.) with 4 g/l of the mixture according to the invention at boiling temperature.

Subsequently, the material was rinsed in 2 passes, hot and cold. The material thus exhibited the following data:

desizing grade (violet scale): grade 9
wettability (immersion method): 8 sec.
whiteness grade (Elrepho): 63
(whiteness grade of the raw material: 48)

The control run was made with 1.5 g/l of amylase solution, as in Example 1 and 2 g/l surfactant mixture as in Example 1.

The desizing obtained was:

desizing grade (violet scale): grade 7
wettability (immersion method): 7 sec.
whiteness grade (Elrepho): 60

EXAMPLE 3

In a stirred container 6.0 kg dodecylbenzene sulfonate sodium salt and
20.2 kg lauryl alcohol oxyethylate (oxyethylation degree 10) with
45.0 l water was mixed to form a homogeneous paste.

Then 33.0 kg of a high-temperature amylase solution was emulsified into the paste. A yellowish-brown paste was obtained. The amylase solution used had an activity of 940 000 units measured according to the method of the technical specifications of Chapter 29.40 of the Customs Tariff.

With the desizing agent thus obtained, a cotton cord which had been sized with a combination of native and modified starch was treated. The size content was 8.0%.

The material was treated in a continuous pretreating system comprising impregnation, steam and washing compartments. The material was impregated with 3 g/l of the mixture in accordance with the invention.

Bath temperature: ca. 90° C.
pH value: ca. 7
squeezing effect: 150%.

Immediately after the wetting, the material was placed in a steam autoclave at a temperature of 110° C. for 60 seconds. Immediately thereafter the material was washed with 3 g/l soda and 1 g/l of commercial washing agent. The desizing grade was 8 (violet scale).

In a control run, the material was impregnated with 1.0 g/l of the identical amylase solution and 1.0 g/l of the above-described surfactant mixture under otherwise the same conditions, steamed and washed.

In spite of the higher amounts of chemicals a desizing effect of only grade 7 was obtained.

EXAMPLE 4

300 kg of Kieralon OL (commercial product of BASF) was stirred together with 400 l of water to form a paste. Immediately thereafter 300 kg of a high-temperature amylase solution was emulsified into the paste over a period of 10 minutes with a Turrax mixer. A yellow-brown paste was obtained. The amylase solution used had an activity of 980,000 enzyme units measured according to the method of the technical specifications in Chapter 29.40 of the Customs Tariff.

A cotton cretonne having a size content of 8.1% comprising 5.5% modified starch, 2.1% PVA and 0.5% fat was desized with the mixture in accordance with the invention. It was discontinuously treated by impregnation on the singer and immediately thereafter washed in a series washing machine.

In the soaking trough of the singer the material was impregnated with 5 g/l of the mixture according to the invention (bath temperature 95° C., pH 7.5), squeezed (110% bath retention) and formed into a ball. The ball was then immediately washed without any residence time. The 4 washing compartments of the series washing machine used were charged as follows:

1st compartment: hot water, ca. 90° C.;
2nd compartment: 3 g/l soda and 1 g/l commercial washing agent, ca. 90° C.;
3rd compartment: hot water, ca. 90° C.;
4th compartment: cold water, ca. 35° C.

The fabric thus treated showed a desizing effect of grade 7 in accordance with the violet scale.

The control desizing was carried out under the same conditions with 1.6 g/l of the same amylase solution and 1.5 g/l of Kieralon OL.

The desizing grade was less than 6.

Alkyl and alkaryl oxalkylates are specifically oxalkylated hydroxy compounds, e.g. oxalkylated alkyl phenols and oxalkylated fatty alcohols.

The foregoing description of the invention has been presented describing certain operable and preferred embodiments. It is not intended that the invention should be so limited since variations and modifications thereof will be obvious to those skilled in the art, all of which are within the spirit and scope of this invention.

What is claimed is:

1. A composition for removing starch and starch-containing sizing materials comprising an emulsion or dispersion of 10–40% of high temperature aqueous amylase enzyme effective as a desizing agent at about 100° C. or higher, an anionic surfactant present in an amount of 0.5% and a non-ionic surfactant selected from the group consisting of alkyl oxalkylates, alkaryl oxalkylates and fatty acid ethyloxylates present 10–60% with the balance water.

2. A composition as in claim 1, wherein the anionic surfactant is a paraffin sulfonate.

3. A composition as in claim 1, wherein the non-ionic surfactant is an alkylphenol oxethylate.

4. A composition as in claim 1, containing 0.5–20% paraffin sulfonate, 10–40% alkylphenol oxethylate, and 10–40% of the enzyme, the remainder being water.

5. A composition as in claim 1, containing 1–10% paraffin sulfonate, 15–25% alkylphenol oxylate, 25–40% of the enzyme preparation, with the remainder being water.

6. A composition as in claim 1, wherein the surfactant comprises essentially 5–15 parts of paraffin sulfonate sodium salt and 50–70 parts of alkylphenol oxethylate.

7. A composition as in claim 1, wherein the components are emulsified with one another.

8. A composition for removing starch and starch-containing sizing materials consisting essentially of an emulsion or dispersion of 10–40% of a starch-decomposing aqueous high temperature amylase enzyme, effective as a desizing agent at about 100° C. or higher and 10–60% of a non-ionic surfactant selected from the group consisting of alkylphenol oxalkylate, oxalkylated fatty alcohols and fatty acid othyloxylate, with the balance water.

* * * * *